US009068364B2

(12) United States Patent
Troudt

(10) Patent No.: US 9,068,364 B2
(45) Date of Patent: Jun. 30, 2015

(54) METHOD OF FORMING CONCRETE UTILIZING ROLL FORMS

(71) Applicant: David F. Troudt, Monument, CO (US)

(72) Inventor: David F. Troudt, Monument, CO (US)

( * ) Notice: Subject to any disclaimer, the term of this patent is extended or adjusted under 35 U.S.C. 154(b) by 0 days.

(21) Appl. No.: 14/229,906

(22) Filed: Mar. 29, 2014

(65) Prior Publication Data

US 2014/0291478 A1 Oct. 2, 2014

Related U.S. Application Data

(60) Provisional application No. 61/807,039, filed on Apr. 1, 2013, provisional application No. 61/947,696, filed on Mar. 4, 2014.

(51) Int. Cl.
*E04G 21/02* (2006.01)
*E04G 9/08* (2006.01)
*E04G 13/02* (2006.01)

(52) U.S. Cl.
CPC ..... *E04G 21/02* (2013.01); *Y10T 29/49963* (2015.01); *E04G 9/08* (2013.01); *E04G 13/021* (2013.01); *E04G 9/083* (2013.01)

(58) Field of Classification Search
CPC ..... E04G 9/08; E04G 9/083; E04G 13/02; E04G 13/021; E04G 21/02
USPC ..... 249/2, 3, 4, 5, 6, 7, 34, 48, 49, 51; 52/741.15; 264/31, 32
See application file for complete search history.

(56) References Cited

U.S. PATENT DOCUMENTS

| | | | | |
|---|---|---|---|---|
| 1,482,700 | A * | 2/1924 | Ratzesberger | 249/5 |
| 1,700,889 | A * | 2/1929 | Heltzel | 249/4 |
| 1,916,796 | A * | 7/1933 | Hirschhorn | 249/7 |
| 2,741,821 | A * | 4/1956 | Findley | 249/189 |
| 3,680,823 | A * | 8/1972 | Lougheed | 249/3 |
| 3,979,100 | A * | 9/1976 | Phillips | 249/48 |
| 4,579,312 | A * | 4/1986 | White | 249/6 |
| 4,824,068 | A * | 4/1989 | Ferland | 249/2 |
| 5,186,874 | A * | 2/1993 | McLaughlin | 264/35 |
| 6,021,994 | A * | 2/2000 | Shartzer, Jr. | 249/6 |
| 6,578,814 | B2 * | 6/2003 | Hoyle et al. | 249/3 |
| 6,705,582 | B2 * | 3/2004 | Osborn | 249/6 |
| 6,874,288 | B1 * | 4/2005 | Washa et al. | 52/371 |
| D522,024 | S * | 5/2006 | McLellan | D15/136 |
| 2001/0010410 | A1 * | 8/2001 | Meehan et al. | 264/31 |
| 2002/0145099 | A1 * | 10/2002 | Hoyle et al. | 249/188 |
| 2003/0042393 | A1 * | 3/2003 | Osborn | 249/6 |

* cited by examiner

*Primary Examiner* — Michael Safavi

(57) ABSTRACT

A form for producing a hardened element such as concrete, formed of a flowable material, the form comprising: an elongated, substantially self-supporting portion of flexible material comprising at least one forming surface for abutting the flowable material; first and second flanges hingedly affixed to respective first and second edges longitudinally of the forming surface; and a plurality of corresponding anchoring holes uniformly placed along the first and second flanges.

9 Claims, 5 Drawing Sheets

METHOD OF FORMING CONCRETE UTILIZING ROLL FORMS

CROSS REFERENCE TO RELATED PATENT APPLICATIONS

The present invention is related to, and claims priority to, U.S. Provisional Patent Application Ser. Nos. 61/807,039 filed Apr. 1, 2013 for "Concrete Forming System" and 61/947,696 filed Mar. 4, 2014 for "Concrete Forming System", the disclosures of which are herein specifically incorporated by this reference in their entirety.

BACKGROUND OF THE INVENTION

The present invention relates, in general, to the field of systems and methods for forming hardened elements from a flowable material such as may be employed in concrete forming. More particularly, the present invention relates to systems and methods for concrete forming of particular utility in the construction of concrete foundation footings, pavement and the like.

Conventionally, concrete foundation footings, or footers, pavement and the like utilize 2×10 or other heavy dimensional lumber as a form which must be transported to a work site and laboriously erected prior to the pouring of concrete. Due to the weight of the wood and the relatively long lengths required, large trucks or trailers must be employed to move the material from one location to another. Moreover, such wooden members are generally not readily useable for repeat applications as they must be cut to shape for each particular job.

SUMMARY OF THE INVENTION

Advantageously provided herein is a compact, lightweight and readily reusable concrete forming system and method for forming foundation footers, pavement and the like utilizing a unique roll form comprising a flexible, substantially self-supporting material capable of being transported and deployed from a rolled form.

In a particular embodiment of the present invention disclosed herein, the roll form may comprise a long flat roll with a main center forming surface section and a flange along each edge. The flanges may be attached with a flexible material continuous along the seam with the main center section. When the roll form is rolled off of a spool and laid flat, the flanges are able to be rotated substantially 90 degrees along the seam. When positioned vertically and upon installation, the top and bottom flanges are folded out to form a "C" shape with 90 degree corners.

The flanges are provided with anchoring holes positioned with a uniform spacing and may also comprise half circle notches along the edges also with a uniform spacing. The holes enable the form stakes, or anchor screws, to hold the roll form in place by driving the form stake through the holes and into the ground or other underlying substrate. The stakes also ensure that the flanges do not fold back into their flat position in a generally coplanar relationship to the center forming surface. Notches, if utilized with the roll form allow for the use of additional stakes and may be placed along the edge for ease of removal by pulling up and away from the form with a stake pulling device. Such notches can also be used as a measurement tool as they can be spaced at commonly used increments standard to the industry.

When the unrolled roll form material is maintained in the vertical "C" position with form stakes it is now made rigid and able to hold poured concrete. A second roll form is then placed opposite to the first roll form to provide the other side of the concrete form employing the same method. Ties, or straps, which may be made of the same flexible, self-supporting material are used to connect across the pair of opposing roll forms to add holding strength against the pour pressure of the flowing concrete.

The width of the roll form, (the center forming surface section with flanges in the flat rolled up position) can be advantageously manufactured to the desired width of the footing to be formed and therefore be used as a template to locate the footing edge between two points placed on the ground. The flat roll edges can be placed in a straight line between the points and the edge along the dirt can be marked with chalk, paint or other means. The roll form may then be folded out and placed along the edge just drawn. Both edges can then be marked to indicate the opposite line for the second form.

Lines placed longitudinally along the center main section, or forming surface, can be used to indicate the top of the poured surface of the concrete. The lines can be used as a measure of depth for the concrete at increments common to the industry.

The roll forms maintained in the vertical "C" position through the use of the form stakes can be made to provide curvilinear and angled shapes by incising or cutting the flanges, such as through the holes and notches provided. By cutting the flange the roll form is able to bend and curve to form corners and radiused footings and edges. Cuts can be made with a hand-held utility knife or shear. Sheet metal shears are readily available and sufficient for this purpose.

After the concrete has been allowed to cure and the form stakes and straps removed, the roll form can again be rolled up on a spool and transported to the next work site. Splices of the roll form can be achieved easily by abutting the ends of two roll form portions and overlapping a splice made of a piece of the same roll form material and width of the flange with holes that are spaced to match the roll form flange holes. Form stakes are then placed through the splice holes and form holes all the way through and into the ground to hold everything in place.

Roll form ties, or straps, across opposing roll forms may be made of the same material and width of the flange with a hole placed a distance of the desired width of the foundation footing or pavement. Such straps span across from the top flange to the top flange of the opposite form and are staked through to the ground. In a similar manner, corner ties of varying angles can be manufactured with holes lining up with form flange holes to form at any angle.

The roll form of the present invention can also be stepped by stacking cut sections and placing the flanges on top of each other and staking all the way through to the ground with form stakes or anchor screws.

When not in use as a form and when being transported to or from a work site, several spools of the roll form disclosed herein can fit on a common shaft and then loaded onto a truck bed, trailer, self-propelled vehicle etc. Spools can be wound or unwound manually or through the use of a power device.

Roll forms can be readily manufactured in all standard sizes common to the industry or made to order in custom sizes. Common sizes would be used for pouring concrete for building foundation footings, sidewalks, driveways and landscaping. Shapes that can readily be produced through the use of the roll form can be rectilinear with angular corners to curves of any radius or a combination of rectilinear, angular and curved. Roll forms can be used for both structural and decorative applications.

While many products are available for concrete forming, the roll form of the present invention has numerous advantages over all of them in it can be rolled out, used, then rolled back up with minimal effort. Other advantages and features of the present invention include being able to utilize the form edge to locate its placement, that it is lightweight, easy and fast to position and take down following use. In addition, the material used in the construction of the roll form, for example, a flexible but rigid self-supporting vinyl, high-density polyethylene (HDPE) or other plastic material, is readily reusable and recyclable.

Particularly disclosed herein is a form for producing a hardened element formed of a flowable material. The form comprises an elongated, substantially self-supporting portion of flexible material comprising at least one forming surface for abutting the flowable material. First and second flanges are hingedly affixed to respective first and second edges longitudinally of the forming surface and a plurality of corresponding anchoring holes are uniformly placed along the first and second flanges.

Also particularly disclosed herein is a method for producing a concrete form which comprises supplying at least one spool of elongated roll form material comprising a forming surface thereof having first and second hingedly affixed flanges along upper and lower edges thereof with the flanges presenting regularly spaced anchoring holes. At least two portions of the roll form material are unwound from the spool and are placed in a generally parallel and spaced apart relationship. The flanges of the at least two portions of said roll form are positioned perpendicularly to, and in a direction opposite to, the forming surface of each of the two portions of the roll form. Anchor screws are extended through at least some of the anchoring holes in the flanges to secure the at least two portions of the roll form to the ground. In use, concrete may then be poured between the forming surfaces of each of the two portions of the roll form.

BRIEF DESCRIPTION OF THE DRAWINGS

The aforementioned and other features and objects of the present invention and the manner of attaining them will become more apparent and the invention itself will be best understood by reference to the following description of a preferred embodiment taken in conjunction with the accompanying drawings, wherein.

DESCRIPTION OF A REPRESENTATIVE EMBODIMENT

Figure 1:
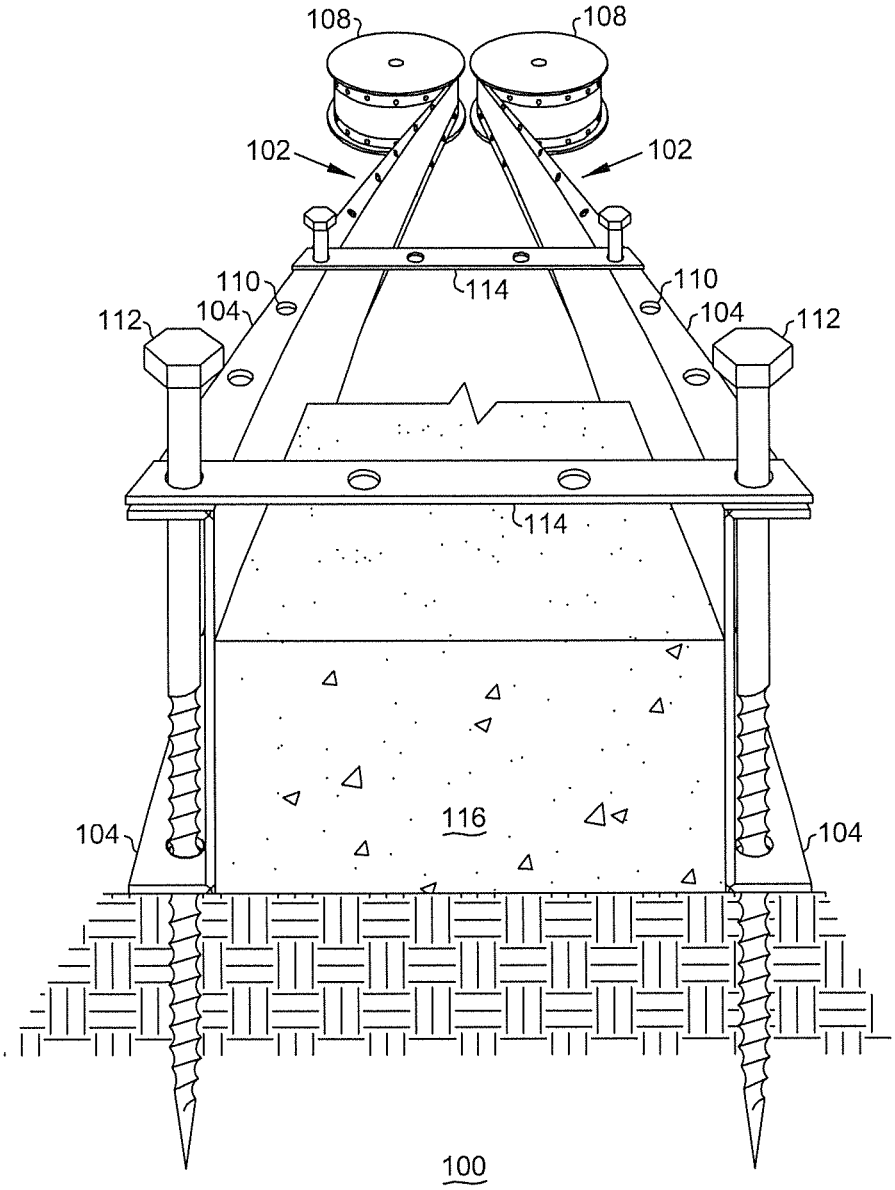
FIG. 1 is a perspective view of a particular application of a pair of the roll forms of the present invention in conjunction with interconnecting straps and anchoring screws for use, for example, in forming concrete footings.

With reference now to FIG. 1, a perspective view of a particular application 100 of a pair of roll forms 102 of the present invention is shown in conjunction with interconnecting straps 114 and anchoring screws 112 for use, for example, in forming a concrete foundation footing 116. In this example application 100, a pair of spools 108 of roll forms 102 are transported to a work site in the bed of a pickup truck. The roll forms 102 on the spools 108 have their flanges 104 substantially coplanar with their respective forming surfaces 106. As the roll forms 102 are unwound from the spools 108, the flanges 104 are moved to a position substantially perpendicular to the forming surfaces 106 in order to enable form stakes, herein illustrated as anchor screws 112, to be extended through anchoring holes 110 in the upper and lower flanges 104 and secured to the ground or other underlying substrate. By positioning opposing pairs of the roll forms 102 as shown, ties or straps 114 may also be secured by the anchor screws 112 at a distance between the pairs determined by the desired width of the foundation footing and then concrete 116 poured therebetween. Once the concrete 116 has cured and is set, the anchor screws 112 may then be removed along with the straps 114 and the roll forms 102 rewound around their respective spools 108 (whether manually or by electric motor or other means) for removal from the work site for transport and use at another.

In a representative embodiment of the present invention, the roll forms 102 may comprise a flexible but rigid self-supporting vinyl, high-density polyethylene (HDPE) or other plastic material. In this regard, the flanges 104 may form a part of the same material as the forming surfaces 106 and a hinged attachment between the flanges 104 and forming surfaces 106 may be effectuated by scoring a longitudinal line between the two elements to enable the positioning of the flanges 104 with respect to the forming surfaces 106. In like manner, the flanges 104 might also be affixed to the forming surfaces 106 by means of an adhesive binding or other suitable means. Although anchor screws 112 have been illustrated as one means of securing the roll forms 102 to the ground, it should be noted that other devices such as stakes, pins, pegs, spikes or reinforcing bar material may also be employed.

Figure 2:
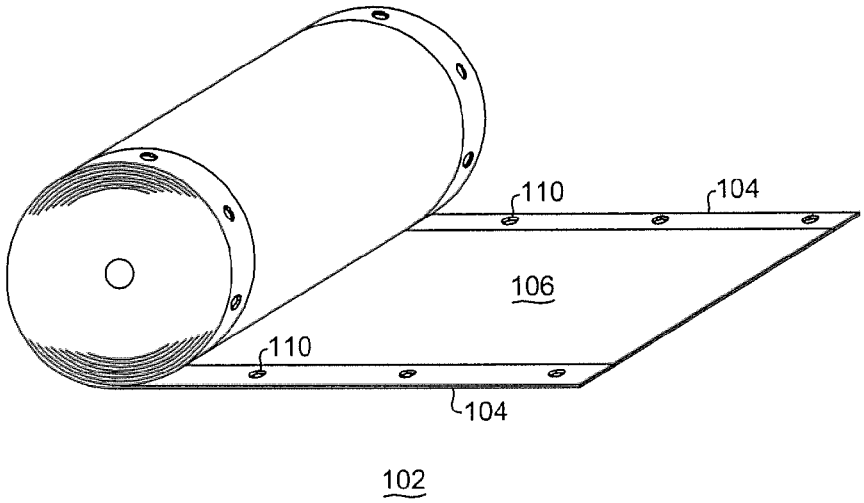
FIG. 2 is an isometric view of an exemplary implementation of a roll form in accordance with the present invention illustrative of the forming surface thereof in conjunction with two hingedly attached flanges with regularly spaced anchoring holes provided therein.

With reference additionally now to FIG. 2, an isometric view of an exemplary implementation of a roll form 102 in accordance with the present invention is shown illustrative of the forming surface 106 thereof in conjunction with two hingedly attached flanges 104 with regularly spaced anchoring holes 110 provided therein.

Figure 3:
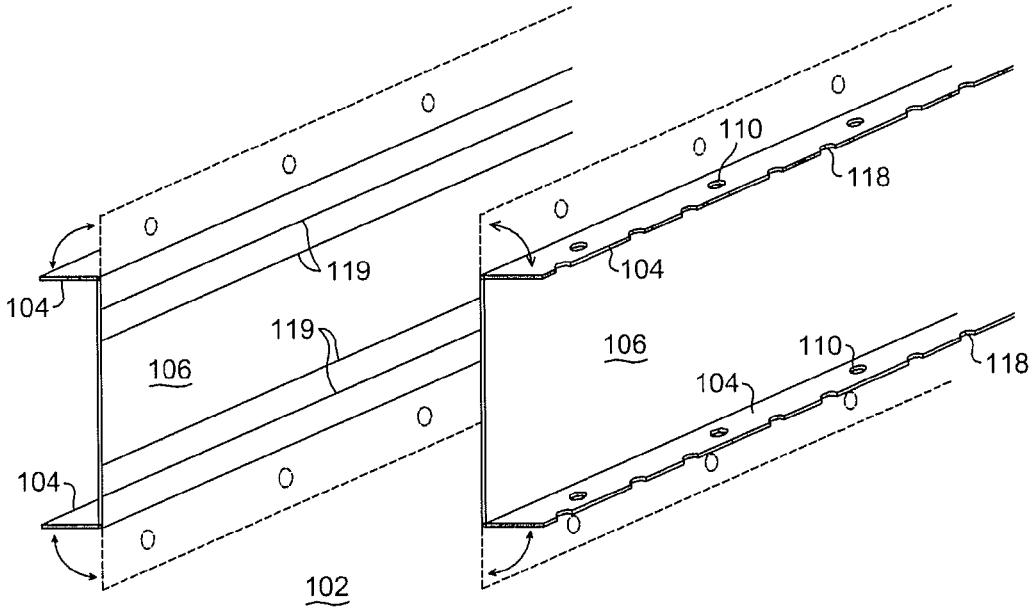
FIG. 3 is an isometric view of two opposing roll forms indicative of the flanges being hingedly moved to a position substantially perpendicular to the forming surfaces thereof.

With reference additionally now to FIG. 3, an isometric view of two opposing roll forms 102 is shown indicative of the flanges 104 being hingedly moved from a substantially coplanar relationship with the forming surfaces 106 to a position substantially perpendicular to the same. As shown in this illustration, the roll form 102 flanges 104 may also include optional notches 118 which may be used in conjunction with, for example, smooth form stakes instead of, or in addition to, anchor screws 112. Further illustrated are a number of level of pour lines 119 to facilitate sighting of the top surface of a concrete pour.

Figure 4:
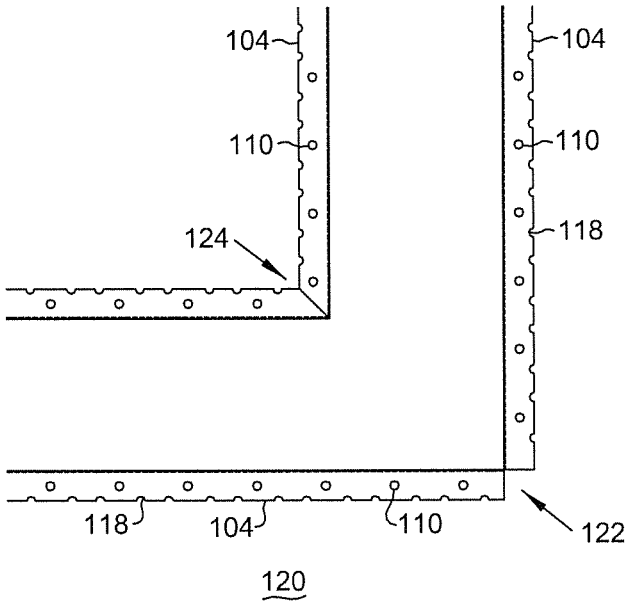
FIG. 4 is a partial, top plan view of a pair of two opposing roll forms indicative of how the flanges of the roll forms can be cut in order to form outside and inside corners, for example, in the formation of a right angled corner of a concrete foundation footing.

With reference additionally now to FIG. 4, a partial, top plan view of a pair of two opposing roll forms 102 is shown indicative of how the flanges 104 of the roll forms 102 can be incised or cut in order to form outside and inside corners 122, 124, in a representative application 120 thereof, for example, in the formation of a right angled corner of a concrete foundation footing. In this regard, the forming surface 106 may be angled 90 degrees towards itself to form an outside corner 122 by cutting the flange 104 along a substantially straight line as shown. Conversely, the forming surface 106 may be angled 90 degrees away from itself by making two 45 degree cuts in the flange 104 substantially as shown.

Figure 5:
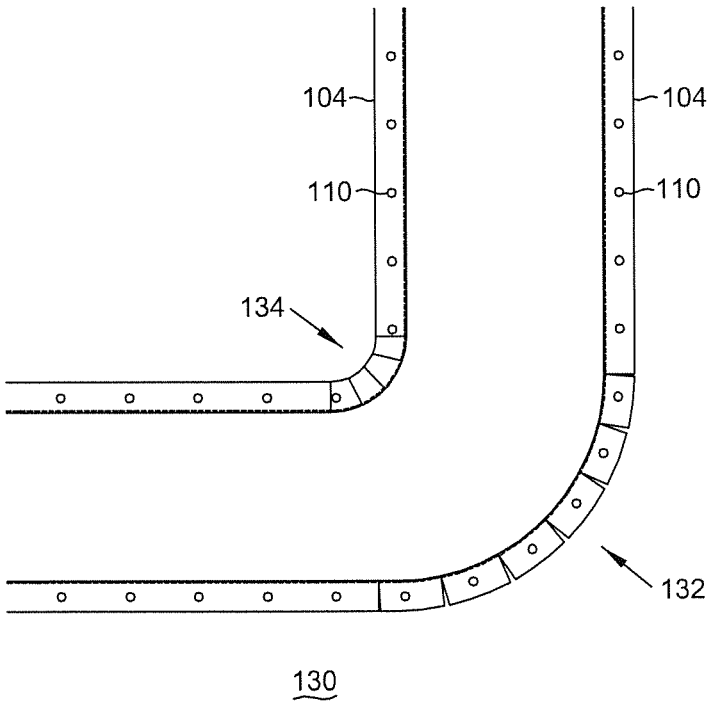
FIG. 5 is a corresponding partial, top plan view of a pair of two opposing roll forms indicative of how the flanges of the roll forms can be cut in order to form outside and inside corners, for example, in the formation of a radiused corner of a concrete footing.

With reference additionally now to FIG. 5, a corresponding partial, top plan view of a pair of two opposing roll forms 102 is shown indicative of how the flanges 104 of the roll forms 102 can be incised or cut in order to form outside and inside corners 132, 134, in a representative application 130 thereof, for example, in the formation of a radiused corner of a concrete footing. In this regard, the forming surface 106 may be curved 90 degrees towards itself to form an outside corner 132 by cutting the flange 104 at multiple places as shown. Conversely, the forming surface 106 may be curved 90 degrees away from itself by making removing multiple angled portions in the flange 104 substantially as shown.

Figure 6:
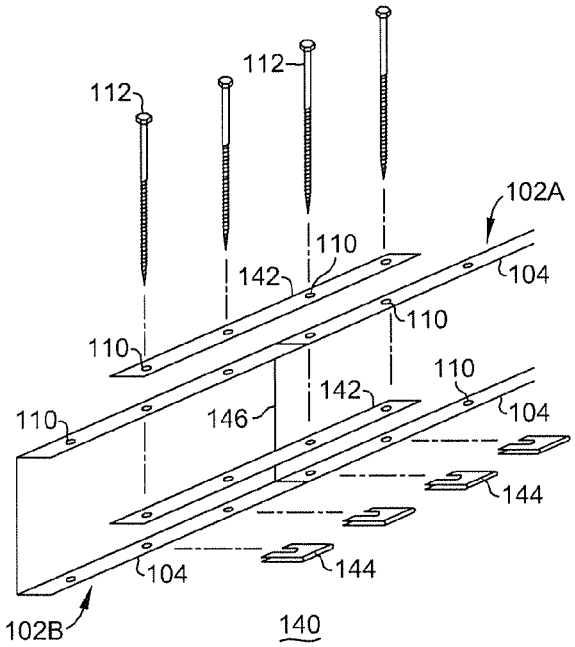
FIG. 6 is an isometric view of a pair of roll forms with abutting ends capable of being held in alignment through the use of a pair of first and second splices and optional clips for further securing the splices or threadably engaging the anchoring screws.

With reference additionally now to FIG. 6, an isometric view of a pair of roll forms 102A and 102B with abutting ends 146 is shown capable of being held in linear alignment through the use of a pair of first and second splices 142. Optional clips 144 may be utilized to further secure the splices 142 or for engaging the anchoring screws 112 in a representative application 140 thereof. The splices 142 may be formed of the same material as the roll forms 102A and 102B.

Figure 7:
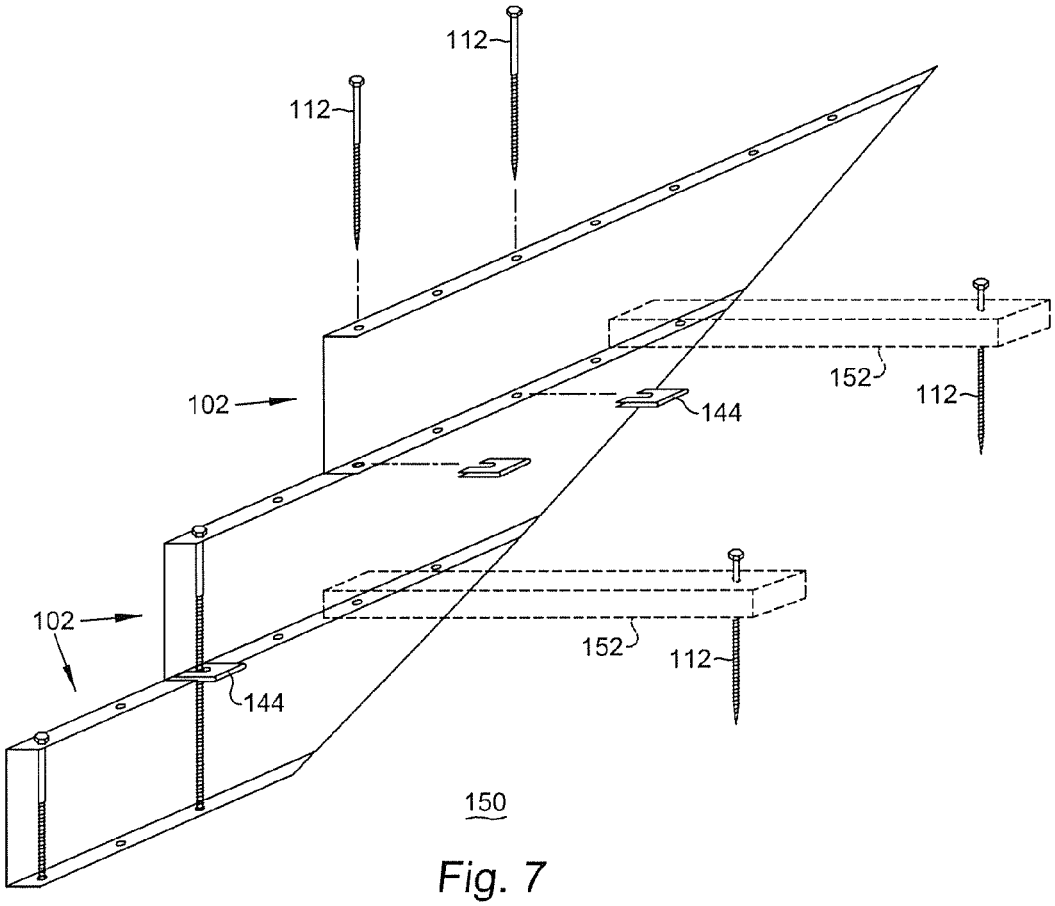
FIG. 7 is a partial isometric view of a possible application of the roll forms of the present invention enabling the formation of steps on a surface grade.

With reference additionally now to FIG. 7, a partial isometric view of a possible application of the roll forms 102 of the present invention is shown enabling the formation of steps on a surface grade in a representative application 150 thereof. In this representative implementation of the roll forms 102 of the present invention, stacked roll forms 102 may be secured together through the use of anchor screws 112 secured through corresponding anchoring holes 110 in overlapping roll forms by means of, for example, clips 144 threadably engaging the anchoring screws 112. The assembly may be further secured to the surface grade through the use of supports 152 coupled to the stacked roll forms 102.

Figure 8:
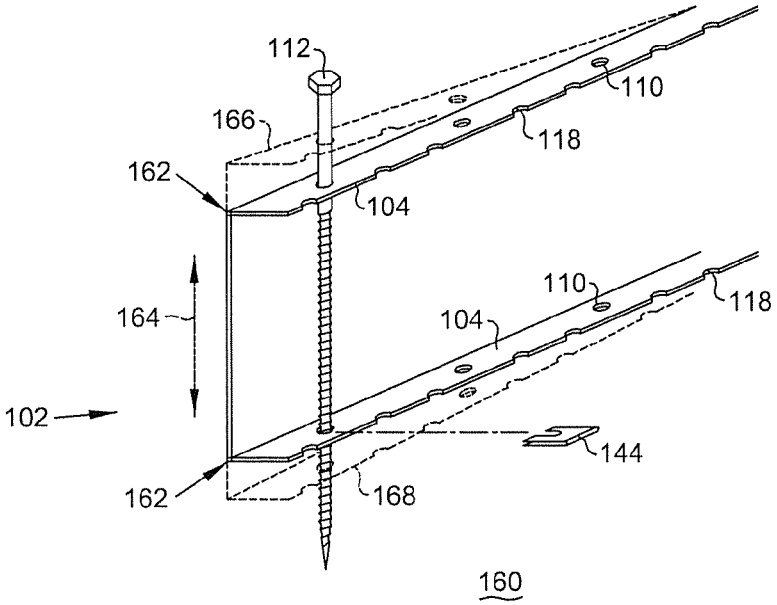
FIG. 8 is a partial isometric view of a portion of a roll form illustrative of the hinged interface between the two flanges and the forming surface utilizing a clip threadably engaging an anchor screw to enable elevational adjustment of the height of the roll form to provide a leveling function.

With reference additionally now to FIG. 8, a partial isometric view of a portion of a roll form 102 is shown illustrative of the hinged interface 162 between the two flanges 104 and the forming surface 106 utilizing a clip 144 threadably engaging an anchor screw 112 to enable elevational adjustment of the height of the roll form 102 to provide a leveling function in a representative application 160 thereof. In this manner, and as illustrated, the height of the roll form 102 may be adjusted either upwardly or in a downward direction as indicated at arrow 164 between an upward position 166 and a downward position 166.

The flange 104 seam hinge line can be made by adhering a binding or tape-like material between the flange 104 and the forming surface 106 or by chemically or thermally weakening the interface between the two. Alternatively, the material comprising the roll forms 102 may be scored along the hinge line or a piano-type hinge mechanism employed.

Figure 9A:
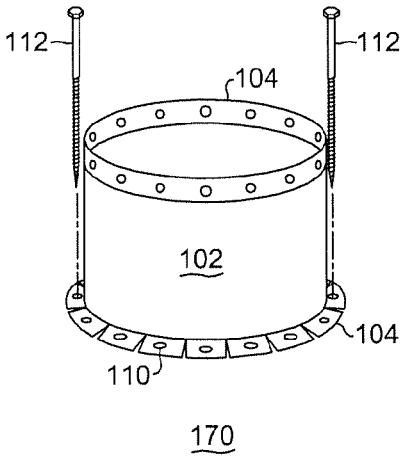
FIGS. 9A and 9B are respective isometric views of exemplary applications of the roll form of the present invention in the formation of circular, rectilinear or other possible geometric shaped forms.
Figure 9B:
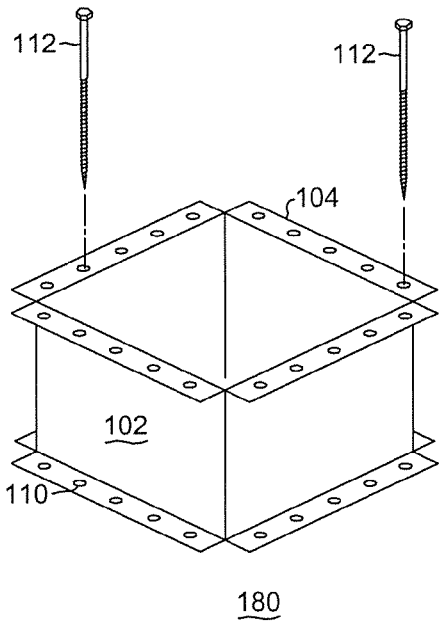

With reference additionally now to FIGS. 9A and 9B, respective isometric views of exemplary applications 170, 180 of the roll form 102 of the present invention are shown in the formation of circular, rectilinear or other possible geometric shaped forms 170, 180. With particular reference to FIG. 9A, a cylindrical shaped form 170 can be made from the roll form 102 and a base for the form 170 made by making a number of cuts in the lower flange 104 as in the outside corner 132 of FIG. 5. In like manner with respect to the representative rectilinear form 180 of FIG. 9B, a base can be made by making substantially straight cuts in the lower flange 104 as in the outside corner 122 of FIG. 4. With respect to either of the exemplary applications 170, 180, abutting or overlapping portions of the roll form 102 may be secured either mechanically or through the use of adhesives. It should be noted that although cylindrical and rectilinear applications of the roll form 102 are shown, the roll form 102 of the present invention can be readily adapted to produce forms of any desired geometric shape or cross-section.

While there have been described above the principles of the present invention in conjunction with specific apparatus and methods, it is to be clearly understood that the foregoing description is made only by way of example and not as a limitation to the scope of the invention. Particularly, it is recognized that the teachings of the foregoing disclosure will suggest other modifications to those persons skilled in the relevant art. Such modifications may involve other features which are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The applicant hereby reserves the right to formulate new claims to such features and/or combinations of such features during the prosecution of the present application or of any further application derived therefrom.

As used herein, the terms "comprises", "comprising", or any other variation thereof, are intended to cover a non-exclusive inclusion, such that a process, method, article, or apparatus that comprises a recitation of certain elements does not necessarily include only those elements but may include other elements not expressly recited or inherent to such process, method, article or apparatus. None of the description in the present application should be read as implying that any particular element, step, or function is an essential element which must be included in the claim scope and THE SCOPE OF THE PATENTED SUBJECT MATTER IS DEFINED ONLY BY THE CLAIMS AS ALLOWED. Moreover, none of the appended claims are intended to invoke paragraph six of 35 U.S.C. Sect. 112 unless the exact phrase "means for" is employed and is followed by a participle.

I claim:

1. A method for producing a concrete form comprising:

supplying at least one spool of elongated roll form material comprising a forming surface thereof having first and second hingedly affixed flanges along upper and lower edges thereof, said flanges presenting regularly spaced anchoring holes;

unwinding at least two portions of said roll form material from said at least one spool;

placing said at least two portions of said roll form material in a generally parallel and spaced apart relationship;

positioning said flanges of said at least two portions of said roll form perpendicularly to and in a direction opposite to said forming surface of each of said two portions of said roll form; and extending anchor screws through at least some of said anchoring holes in said flanges to secure said at least two portions of said roll form to the ground.

2. The method of claim 1 wherein said roll form material comprises high density polyethylene plastic.

3. The method of claim 2 wherein said first and second hingedly attached flanges are formed by:

scoring said plastic longitudinally along an interface between a side opposite said forming surface and said flanges.

4. The method of claim 1 wherein said flanges are configured to be substantially coplanar with said forming surface on said spool.

5. The method of claim 1 wherein said anchor screws comprise one of stakes, pins, pegs, spikes or reinforcing bar material.

6. The method of claim 1 further comprising the step of:

pouring concrete between said forming surfaces of each of said two portions of said roll form.

7. The method of claim 1 wherein said first and second hingedly attached flanges are affixed to said forming surface by:

providing an adhesive binding between a side of said roll form material opposite said forming surface and said first and second hingedly attached flanges.

8. The method of claim 1 wherein said first and second hingedly attached flanges are formed by:

chemicalley or thermally weakening an interface in said roll form material between a side opposite said forming surface and said flanges.

9. The method of claim 1 wherein said first and said hingedly attached flanges are affixed to said forming surface by:

providing a piano-type hinge mechanism between said forming surface and said first and second hingedly attached flanges.

* * * * *